US009199769B2

(12) United States Patent
Wood et al.

(10) Patent No.: US 9,199,769 B2
(45) Date of Patent: Dec. 1, 2015

(54) CAP FOR A CONTAINER NECK

(75) Inventors: Christopher Wood, Wauwatosa, WI (US); Michel Luzzato, Ecully (FR)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 13/824,991

(22) PCT Filed: May 3, 2012

(86) PCT No.: PCT/EP2012/058163
§ 371 (c)(1),
(2), (4) Date: Apr. 29, 2013

(87) PCT Pub. No.: WO2012/150309
PCT Pub. Date: Nov. 8, 2012

(65) Prior Publication Data

US 2014/0158660 A1 Jun. 12, 2014

(30) Foreign Application Priority Data

May 4, 2011 (FR) ..... 11 53816

(51) Int. Cl.
*B65D 41/34* (2006.01)
*B65D 41/04* (2006.01)

(52) U.S. Cl.
CPC ..... *B65D 41/3428* (2013.01); *B65D 41/0421* (2013.01); *B65D 41/0485* (2013.01)

(58) Field of Classification Search
CPC ..... B65D 41/0404; B65D 41/04; B65D 41/0414; B65D 41/0421; B65D 41/04217; B65D 41/3428; B65D 41/0485
USPC ..... 215/343, 344, DIG. 1
See application file for complete search history.

(56) References Cited

U.S. PATENT DOCUMENTS

| | | | | |
|---|---|---|---|---|
| 5,673,809 | A * | 10/1997 | Ohmi et al. | 215/252 |
| 6,382,445 | B1 * | 5/2002 | McCandless | 215/341 |
| 2002/0166859 | A1 | 11/2002 | McGrew, Jr. | |
| 2005/0006334 | A1 | 1/2005 | Luker | |
| 2009/0159555 | A1 * | 6/2009 | Druitt et al. | 215/344 |

FOREIGN PATENT DOCUMENTS

| | | | |
|---|---|---|---|
| DE | 14 82 569 | A1 | 6/1969 |
| DE | 20 35 246 | A1 | 1/1972 |
| DE | 80 34 018 | U1 | 4/1984 |

OTHER PUBLICATIONS

International Search Report of PCT/EP2012/058163, mailed on May 30, 2012, 3 pages.

* cited by examiner

*Primary Examiner* — Fenn Mathew
*Assistant Examiner* — James N Smalley
(74) *Attorney, Agent, or Firm* — Finnegan, Henderson, Farabow, Garrett & Dunner LLP

(57) ABSTRACT

A cap for a container neck includes a tubular skirt defining a central axis. The skirt includes an internal first skirt part, means for removably fixing the first skirt part to an exterior surface of the container neck, and a second skirt part. The second skirt part includes a first axial end connecting the second skirt part to the first skirt part, internally having at least one surface adapted to abut a free end of the container neck. The second skirt part also includes a second axial end opposite the first end, and an intermediate part extending between the first and second ends. Ribs project radially from the intermediate part in a direction substantially parallel to the axis. A radial dimension of the intermediate part is less than a radial distance between the exterior cylindrical surface of the first skirt part and the interior radial end of the abutment surface.

16 Claims, 8 Drawing Sheets

CAP FOR A CONTAINER NECK

CROSS-REFERENCE TO RELATED APPLICATIONS

This is a U.S. National Phase of PCT/EP2012/058163, filed May 3, 2012, which claims the benefit of priority to French Patent Application No. 1153816, filed May 4, 2011, which is incorporated herein by reference.

TECHNICAL FIELD

The present invention concerns a cap for a container neck.

The invention is directed to plastic material caps that include a tubular skirt designed to be fixed removably around the free end ring of the neck of a container, typically by screwing-unscrewing. This means, among other things, screw caps very widely used to close bottles of mineral water or other foodstuff liquids.

BACKGROUND

In recent years, for both economic and ecological reasons, the height of these caps, i.e. the dimension of these caps in the direction of the central axis of their skirt, has ceaselessly increased, the skirt being reduced, so to speak, to a ring of very small height, the interior cylindrical surface of which is almost entirely occupied by a thread enabling the cap to be screwed onto the end ring of the container neck, which also has the smallest axial size. As a result of this, at present, some users have real difficulty in opening these caps, because the axial dimension of the exterior cylindrical surface of their skirt is so small that their fingers have difficulty grasping these caps effectively to unscrew them, in particular on first opening them, when it is very often necessary to break indicators of first opening, for example when a non-removable axial part of the skirt is retained around the container neck, while the rest can be unscrewed and removed, subject to breaking a line of weakening separating the non-removable skirt part and the removable skirt part. Moreover, the arrangements of the container neck linked to the indicators of first opening of the cap can accentuate the difficulties referred to above: thus the flange generally present at the base of the ring to limit how far the non-removable skirt part can drop makes it even more difficult to grasp the "small" removable skirt part.

Of course, one solution to the problem defined above would be to revert to the old dimensions of the caps and their associated rings. However, the object of the present invention is to propose an improved cap which, whilst being capable of being fixed removably to a present-day container neck, i.e. to a container neck the ring of which has a small axial dimension, is easier for users to manipulate, notably to open.

BRIEF SUMMARY

To this end, the invention consists in a cap for a container neck, including a tubular skirt which defines a central axis and which includes, successively along this axis, a first skirt part, provided internally with means for removably fixing it to the exterior surface of the container neck, and a second skirt part including:

- a first axial end which connects the rest of the second skirt part to the first skirt part and which is provided internally with at least one surface adapted to abut axially against the free end of the container neck,

- a second axial end which is axially opposite the first end and which is blocked transversely by an end wall of the cap, and
- an intermediate part which extends axially between the first and second ends, from which project radially ribs substantially parallel to the axis and distributed in a direction peripheral to this axis and which, in an axial section half-plane of the skirt, have, outside said ribs, a radial dimension that is strictly less than the radial distance between the exterior cylindrical surface of the first skirt part and the interior radial end of the abutment surface or surfaces.

One of the ideas on which the invention is based is, so to speak, seeking to add, axially between the end wall of the cap and the axial part of the skirt, which is arranged internally to cooperate with the free end ring of a container neck for the purposes of removable fixing, an axial skirt part specific to the invention, in order to increase the overall exterior area of the skirt: accordingly, even in the presence of a container neck ring having a small axial dimension, manipulation of the cap is facilitated because the user's fingers can grasp a large axial extent on the exterior surface of the skirt to turn the cap. Moreover, the cap therefore has a more attractive exterior aesthetic, because of its increased overall volume in the direction away from the plugged container neck. Internally, the "added" skirt part between the end wall and the neck fixing skirt part has features aiming to cap it effectively in axial vertical alignment with the neck of the container, in the form of one or more surfaces that abut axially against the free end of the neck, in order to prevent the "added" skirt part being moved axially so as to line up radially with the ring of the neck. Moreover, given the cap manufacturing constraints, in particular constraints on moulding a plastic material constituting it, the "added" skirt part does not consist of a simple solid extension, which would notably cause hot spot problems during moulding, but, in accordance with the invention, features radially projecting ribs: when these ribs are present on the exterior cylindrical surface of the skirt part specific to the invention, they are advantageously grasped by the user's fingers to turn the cap and/or when these ribs are present on the interior cylindrical surface of the skirt part specific to the invention, they advantageously participate in the axial immobilization of this skirt part. In all cases, these ribs enable the skirt part specific to the invention to be manufactured in such a way that this skirt part has, outside the ribs, a moderate radial thickness, for example of the same order as the radial thickness of the neck fixing skirt part, this being the case whatever the axial dimension of the skirt part specific to the invention.

According to advantageous additional features of the cap in accordance with the invention, taken individually or in all technically possible combinations:

- the second skirt part has a total axial dimension of at least 50% of the axial dimension of the first skirt part occupied by the removable fixing means;
- the cap further includes an annular sealing lip which is arranged coaxially with and inside the skirt and which projects axially from the end wall, being over the whole of its axial dimension at a radial distance from both the interior cylindrical surface of the first and second skirt parts and, if present, ribs projecting from the interior cylindrical surface of the intermediate part of the second skirt part;
- the intermediate part of the second skirt part has interior and exterior cylindrical surfaces the diameters of which are strictly less than those of the interior and exterior cylindrical surfaces, respectively, of the first skirt part, while the or at least one of the abutment surfaces is delimited by an interior shoulder of the first end of the second skirt part, and while at least some or even all of the ribs project from the exterior cylindrical surface of the intermediate part of the second skirt part;

the exterior radial end of each of the ribs projecting from the exterior cylindrical surface of the intermediate part of the second skirt part is situated at a radial distance from the axis that is equal to or greater than the radius of the exterior cylindrical surface of the first skirt part;

each of the ribs projecting from the exterior cylindrical surface of the intermediate part of the second skirt part extends in the direction of the axis in line with an associated rib that projects from the exterior cylindrical surface of the first skirt part;

the abutment surface which is delimited by the interior shoulder of the first end of the second skirt part extends continuously around the whole of the interior periphery of this first end so as to form a sealing line against the exterior edge of the free end of the container neck;

the abutment surface which is delimited by the interior shoulder of the first end of the second skirt part is substantially frustoconical, being centred on the axis and converging toward the rest of the second skirt part;

some ribs project from the interior cylindrical surface of the intermediate part of the second skirt part and extend axially as far as the axial level of the abutment surface delimited by the interior shoulder of the first end of the second skirt part so that each of these ribs delimits at its axial end facing toward the first skirt part one of the abutment surfaces other than the abutment surface delimited by the interior shoulder;

the intermediate part of the second skirt part has interior and exterior cylindrical surfaces axially aligned with the interior and exterior cylindrical surfaces, respectively, of the first skirt part, while at least some or even all of the ribs project from the interior cylindrical surface of the intermediate part of the second skirt part and extend axially as far as the axial level of the first end of the second skirt part so that each of these ribs delimits at its axial end facing toward the first skirt part one of the abutment surfaces;

some ribs project from the exterior cylindrical surface of the intermediate part of the second skirt part and extend in the direction of the axis in line with an associated rib that projects from the exterior cylindrical surface of the first skirt part;

each of the ribs projecting from the interior cylindrical surface of the intermediate part of the second skirt part has:

in section in a plane perpendicular to the axis a substantially rectangular contour in the lengthwise direction of which are opposed, on the one hand, an exterior radial edge of the rib which connects the rest of the rib to the interior cylindrical surface of the intermediate part of the second skirt part and, on the other hand, an interior radial edge of the rib, which is free, and opposite each other in the direction of the axis, an axial edge that connects the rest of the rib to the end wall of the cap and an axial, edge which delimits the abutment surface associated with the rib;

the interior radial edge of each of the ribs projecting from the interior cylindrical surface of the intermediate part of the second skirt part is provided with a stiffening enlargement which projects from one of the two faces of the rib, opposite in the widthwise direction of the substantially rectangular contour of this rib, in particular projecting from that of said two faces that faces away from the direction of screwing the cap around the container neck when the removable fixing means are screwing-unscrewing means;

the lengthwise direction of the substantially rectangular contour of each of the ribs projecting from the interior cylindrical surface of the intermediate part of the second skirt part is inclined relative to a direction radial to the axis, in particular inclined on the side of this radial direction that faces away from the direction of screwing the cap around the container neck when the removable fixing means are screwing-unscrewing means.

BRIEF DESCRIPTION OF THE DRAWINGS

The invention will be better understood on reading the following description given by way of example only and with reference to the drawings, in which.

DETAILED DESCRIPTION

Figure 1:
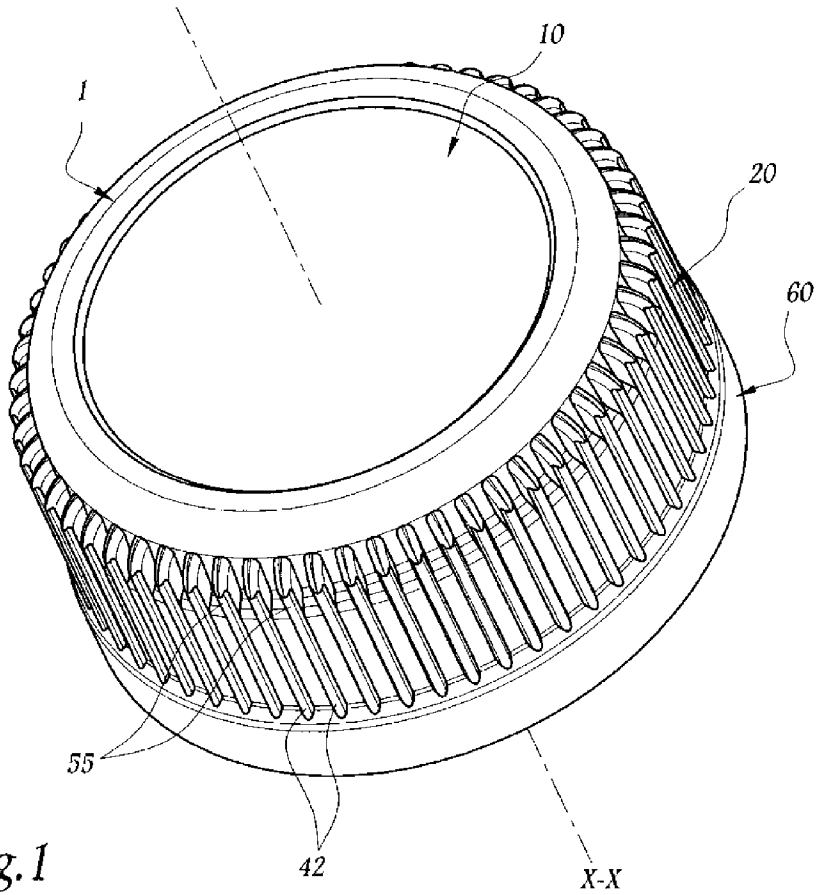
FIG. 1 is a perspective view of a first embodiment of the invention.

In FIGS. 1 to 5 there is represented a cap 1 adapted to be removably fitted to a neck 2 of a container in order to plug this neck.

In practice, the neck 2 is either in one piece with the rest of the container, notably when the latter is a glass or plastic material bottle, or adapted to be fastened permanently to a wall of the container in an opening passing through that wall.

As described in detail hereinafter, the cap 1 has a globally tubular shape with a central longitudinal axis X-X. Similarly, the neck 2 has a globally tubular shape the central longitudinal axis of which coincides with the axis X-X when the cap 1 is plugging the neck.

For convenience, the remainder of the description of the cap 1 is oriented relative to the axis X-X, considering the terms "lower" and "bottom" to qualify a part of the cap that is directed axially toward the container when the cap is plugging the neck 2 of this container. Conversely, the terms "upper" and "top" correspond to the opposite axial direction. Similarly, the term "interior" qualifies a part of the cap 1 that is directed transversely toward the axis X-X while the term "exterior" corresponds to the opposite transverse direction.

The neck 2 includes a globally cylindrical body or ring 3 with a circular base, centred on an axis coinciding with the axis X-X when the cap 1 is plugging the neck. The top axial end 4 of the ring 3 is free, being open to the outside, whereas at its opposite axial end the ring 3 opens into the rest of the container. At its free end 4 the ring 3 delimits an edge 4A where the product contained in the container is intended to be poured out and that is connected to the exterior lateral face 3A of the ring 3 by an exterior edge 4B. This exterior face 3A of the ring 3 is provided successively from top to bottom with a helical thread 5, a heel 6 and a flange 7, all of which project radially outward.

As mentioned above, the cap 1 has a globally tubular shape, centred on the axis X-X. As can be seen clearly in FIGS. 1 and 2, the cap 1 is open at its lower end and is closed at its upper end by an end wall 10 which, in the embodiment considered here, is globally plane, having a disc-like shape centred on the axis X-X. From the exterior peripheral part of the end wall 10 there extend downward both an exterior tubular skirt 20, which will be described in detail later, and an interior annular lip 30, both centred on the axis X-X. The aforementioned lip 30 includes a free lower axial part 31 that is connected to the end wall 10 by the rest of the lip 30, forming an upper axial lip part 32, and which is provided on its exterior face with a radially projecting raised pattern 33. This raised pattern 33 extends continuously around the whole of the exterior periphery of the lower lip part 31, thus being adapted to bear in sealed manner against the interior face 3B of the ring 3 of the container neck 2 when the cap 1 is plugging that neck, as in FIG. 2. As is the case in the embodiment considered in the figures, this sealing raised pattern 33 advantageously has an olive-shaped contour, and so the lip 30 is generally qualified as an "olive-lip".

As can be seen clearly in FIG. 2, the skirt 20 includes two tubular axial parts centred on the axis X-X and in succession in the direction of that axis X-X, namely a bottom skirt part 40, which will be described in detail next, and a top skirt part 50, which will be described in detail later and connects the bottom part 40 to the end wall 10.

Figure 2:
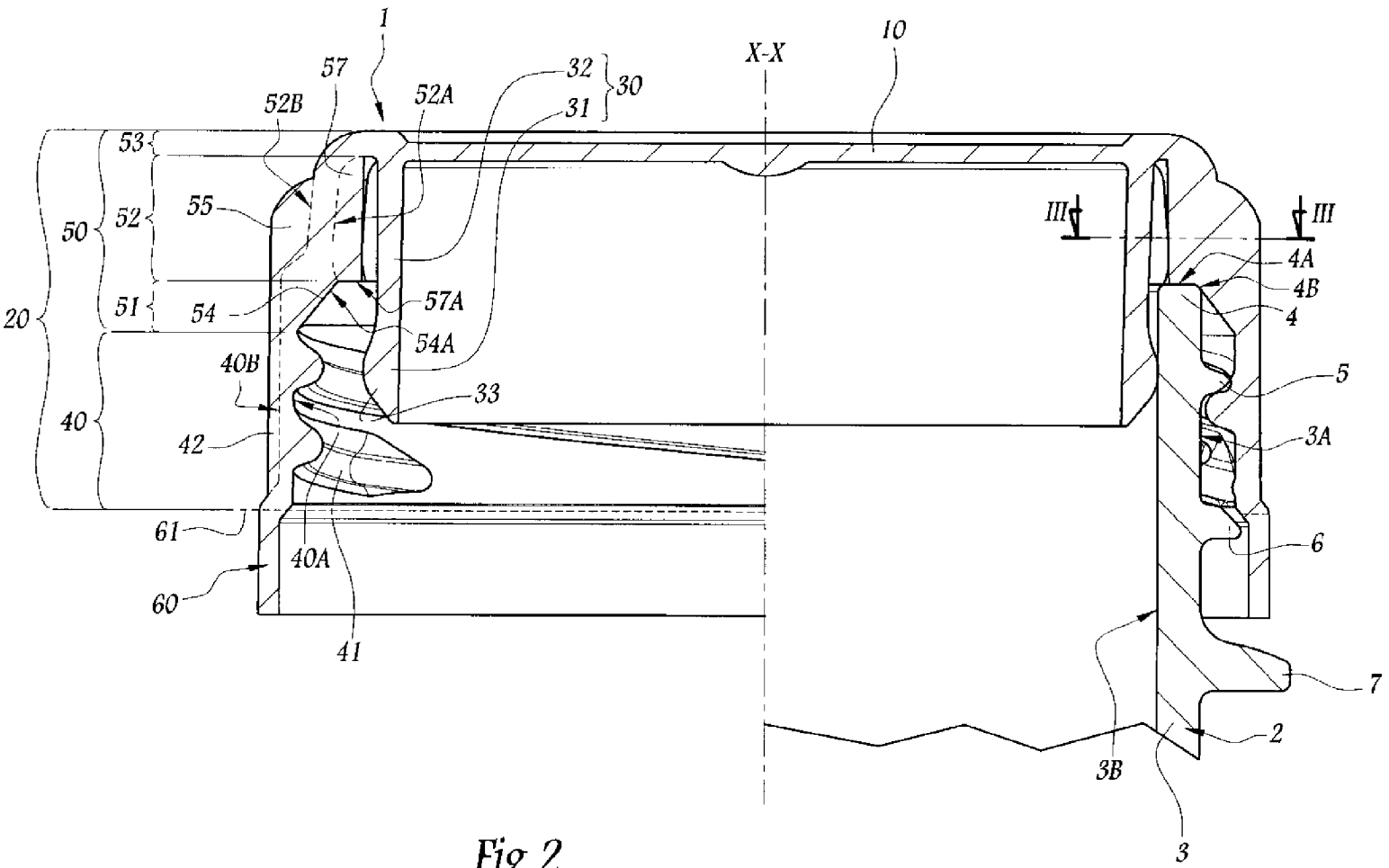
FIG. 2 is an axial section of the cap from FIG. 1, the left-hand half of this section showing the cap on its own, while the right-hand half of this section shows the cap plugging a container neck.

As represented in FIG. 2, the interior cylindrical surface 40A of the bottom skirt part 40 is provided with a thread 41 projecting radially inward and complementary to the exterior thread 5 of the ring 3 of the container neck 2, thus enabling the cap 1 to be screwed onto and unscrewed from the neck. To facilitate grasping and turning the bottom skirt part 40, the exterior cylindrical surface 40B of this skirt part 40 is provided with radially projecting ribs 42 which, as can be seen clearly in FIG. 1, each extend lengthwise parallel to the axis X-X and which are distributed in a substantially uniform manner around the exterior periphery of the skirt part 40.

Moreover, by way of an advantageous optional feature, the bottom skirt part 40 is extended downward by a tamper-evident strip 60. In a manner known in itself, this strip 60 has an annular shape substantially centred on the axis X-X, its upper axial edge being connected to the lower axial edge of the skirt part 40 by a peripheral line 61 of weakening designed to break when the cap 1 is opened the first time. The line 61 of weakening is situated at an axial level that is both below the lower end of the thread 41 and above an interior raised pattern, not represented in the figures, of the tamper-evident strip 60, which raised pattern is adapted to come to abut in the axially upward direction against the heel 6 when the cap 1 is opened the first time, in order to retain the strip 60 around the ring 3 in the axial direction, subject to the line 61 of weakening breaking. Once the tamper-evident strip 60 has been separated, from the bottom skirt part 40, more generally separated from the rest of the cap 1, it tends under its own weight to descend axially along the ring 3 until it comes to rest bearing axially against the flange 7. In that the technical features relating to the tamper-evident strip 60, or more generally to similar means forming indicators of first opening, are well known in the field, they will not be described in more detail here.

As stated above, the top part 50 of the skirt 20 will now be described in more detail, in particular with reference to FIGS. 2 to 5. Accordingly, as indicated in FIGS. 2, 4 and 5, this top skirt part 50 is constituted, successively from the bottom upward along the axis X-X, of a bottom axial end 51 that connects the rest of the skirt part 50 to the bottom skirt part 40, an intermediate axial part 52 that represents the largest axial part of the skirt part 50, and a top axial end 53 that connects the rest of the skirt part 50 to the end wall 10.

Figure 5:
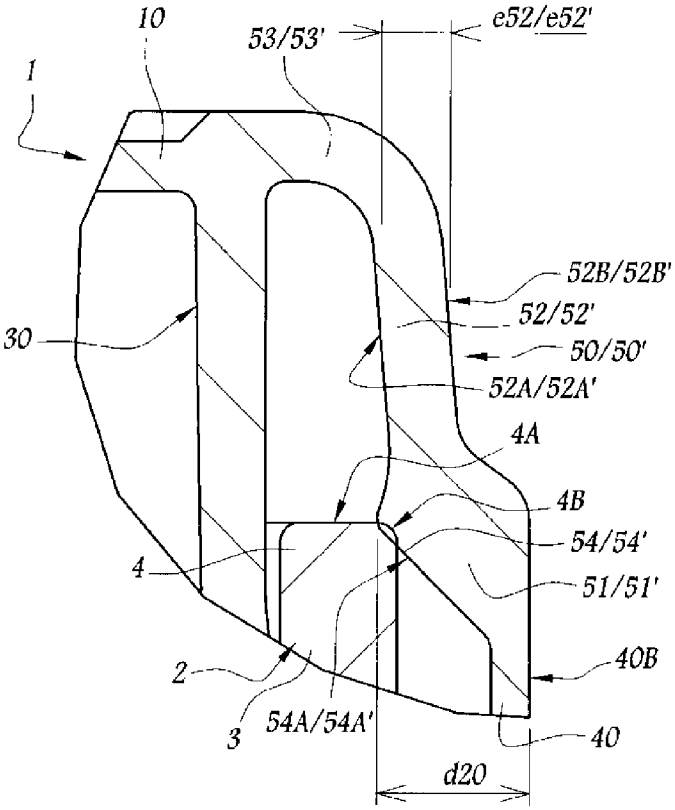
FIG. 5 is a section taken along the line V-V in FIG. 3.

As can be seen clearly in FIG. 5, the intermediate part 52 of the skirt part 50 is not in axial alignment with the bottom skirt part 40 but, to the contrary, the respective diameters of its interior cylindrical surface 52A and its exterior cylindrical surface 52B are strictly less than the diameters of the interior cylindrical surface 40A and the exterior cylindrical surface 40B, respectively, the skirt part 40. As a result of this the bottom end 51 of the skirt part 50 accommodates the changing diametral dimension of the skirt 20, having a globally inwardly shouldered shape, as can be seen clearly in FIG. 5. In particular, as is clear from FIG. 5 and from the left-hand half of FIG. 2, the bottom end 51 of the skirt part 50 includes an interior shoulder 54 that runs over the whole of the interior periphery of this end 51 and delimits a lower surface 54A. In other words, this surface 54A, which faces toward the bottom skirt part 40, runs around the whole of the interior periphery of the top skirt part 50 and, in the embodiment considered in the figures, projects radially inward from the top axial end of the bottom skirt part 40.

As is the case in the embodiment considered in the figures, the aforementioned surface 54A is advantageously frusto-conical, being centred on the axis X-X and converging toward the intermediate part 52 of the top skirt part 50.

Figure 4:
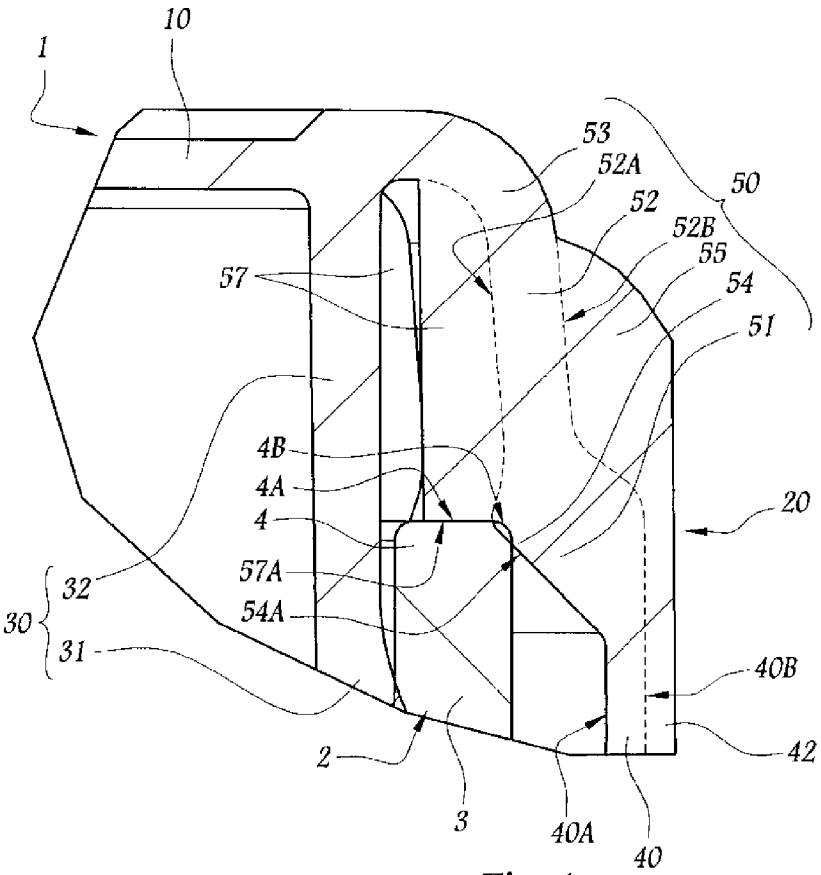
FIG. 4 is a section taken along the line IV-IV in FIG. 3.
Figure 7:
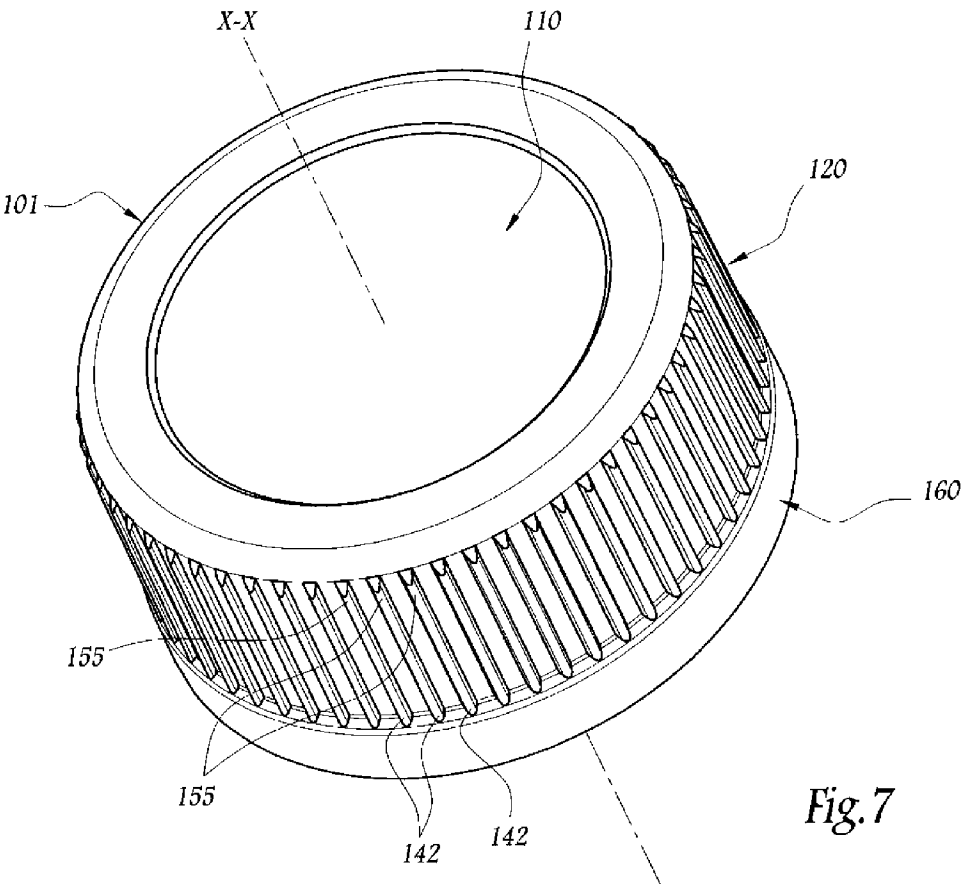
FIG. 7 is a perspective view of a cap of a second embodiment of the invention.

As can be seen clearly in the right-hand part of FIG. 2, as well as in FIGS. 4 and 5, the aforementioned surface 54A is sized, in particular with regard to its radial dimension, so as to come to bear axially against the free end 4 of the ring 3 of the container neck 2 when that neck is plugged by the cap 1, to be more precise to come to bear against the edge 4B of this free end. As a result, by virtue of downward axial bearing of the top skirt part 50 against the free end 4 of the ring 3, the cap 1 is prevented from being driven axially, relative to the container neck 2, lower than it is in FIGS. 2, 4 and 5. Moreover, in that this surface 54A extends continuously around the whole of the interior periphery of the skirt 20, the axial bearing of the top skirt part 50 against the free end 4 of the ring 3 is advantageously sealed in that the cooperation between the surface 54A and the edge 4B of the free end 4 forms a peripheral sealing line.

Externally, the reduction in the diametral dimension of the top skirt part 50 relative to the bottom skirt part 40 implies that the exterior cylindrical surface 52B of the intermediate part 52 is situated radially inside the cylindrical envelope defined by the exterior cylindrical surface 40B of the bottom skirt part 40, as can be seen clearly in FIG. 5. However, as can be seen clearly in FIG. 1, this inward radial [shrinkage] of most of the top skirt part 50 is, so to speak, compensated by the presence of ribs 55 that project radially from the exterior cylindrical surface 52B of the intermediate part 52 of the skirt part 50 and that extend on this exterior cylindrical surface 52 parallel to the axis X-X, being distributed, advantageously in a substantially uniform manner, around the exterior periphery of this surface 52B. In practice, as can be seen clearly in FIG. 3, for the aforementioned compensation to be complete, the exterior radial end 55A of each of these ribs 55 is situated at a radial distance from the axis X-X that is equal to, or even greater than, the radius of the exterior cylindrical surface 40B of the bottom skirt part 40: as a result, when the user applies their fingers around the skirt 20, each finger can easily bear radially against, at one and the same time, the bottom skirt part 40 and the ends 55B of the ribs 55 on the top skirt part 50. This offers the user's fingers a large axial extent for manipulating the skirt 20, notably for turning it on itself about the axis X-X to screw or unscrew it relative to the ring 3 of the container neck 2, in the sense that this radial extent is not limited to that of the bottom skirt part 40, but adds to the latter the axial extent of most of or even virtually all of the top skirt part 50. Of course, this arrangement also enables improved centring of the cap 1 in the machines employed to place it initially on the container neck 2, such as in a screwing cone.

As is the case in the embodiment considered in the figures, each of the ribs 42 provided on the exterior surface 40B of the bottom skirt part 40 advantageously extends in the direction of the axis X-X in alignment with one of the ribs 55, as can be seen clearly in FIG. 1. By sizing the ribs 42 so that their exterior radial end is axially in line with the exterior radial end 55A of the associated rib 55, most or even virtually all of the exterior face of the skirt 20 produces in the user a ribbed raised pattern sensation that is homogeneous in the direction of the axis X-X. This amounts to saying that the depth of the ribs 55, i.e. their projecting radial dimension relative to the exterior cylindrical surface 52B of the intermediate part 52 of the top skirt part 50, is greater than that of the ribs 42 relative to the exterior surface 40B of the skirt part 40, as can be seen clearly in FIG. 1. The result of this is a singular aesthetic.

It will moreover be noted that, because of the presence of the ribs 55, obtaining the large axial extent for the skirt 20, as explained above, does not imply a massive construction of the top skirt part 50 in the sense that, in axial half-section of the skirt 20, as indicated in FIG. 5, the thickness e52 of the intermediate part 52, in other words its radial dimension, outside the ribs 55, this dimension separating from each other the interior cylindrical surface 52A and the exterior cylindrical surface 52B of the intermediate part 52, is not equal to, but strictly less than, the radial distance d20 between the exterior cylindrical surface 40B of the bottom skirt part 40 and the interior radial end of the surface 54. This reflects the fact that, although the top skirt part 50 is used directly, by way of its shouldered surface 54A, to form an axial abutment relative to the ring 3 of the container neck 2, the thickness of this skirt part 50 is, to compensate, not significantly increased toward the outside around the whole of the exterior periphery of this skirt part 50. Such a continuous additional thickness around the whole of the exterior periphery of the skirt part 50 would lead, during manufacture of the cap 1, to the occurrence of hot spots within the mass of material constituting this top skirt part, notably within a plastic material if the cap 1 is manufactured by moulding such a plastic material.

In practice, it is clear that the top skirt part 50 can then be manufactured with a large axial dimension, thus making it possible to reinforce as much as required the obtaining of a large overall axial extent for the skirt 20, with the advantages explained above, linked to manipulating the cap 1. It will be noted that the large axial extent of the skirt 20 is obtained although the bottom skirt part 40 has the exact axial dimension, in the sense that the thread 41 of this skirt part 40 is adapted to cooperate with the thread 5, while the latter has a small axial dimension, which amounts to saying that the ring 3 is a ring having an axial dimension that is intentionally as small as possible, reflecting the considerations set out in the introductory part of the present document. In other words, the cap 1 has the advantage that it can be attached to the ring 3 while the latter has a small axial dimension, at the same time as offering the user a skirt 20 having a large axial extent for easy manipulation of the cap 1. In practice, in terms of advantageous dimensions, the top skirt part 50 has a total axial dimension equal to at least 50%, or even 100%, or more, of the axial dimension of the thread 41 of the bottom skirt part 40.

It will moreover be noted that the top end 53 of the top skirt part 50 is not connected directly to the top part 32 of the lip 30, which would limit the bending capabilities of this lip 30, used so that the raised pattern 33 bears in sealed manner against the interior face 3B of the ring 3 of the container neck 2 when that neck is plugged by the cap 1. To the contrary, as can be seen clearly in FIG. 5, the interior cylindrical surface of the skirt part 50 is, over the whole of its axial dimension, at a radial distance from the upper part 32 of the lip 30.

Figure 3:
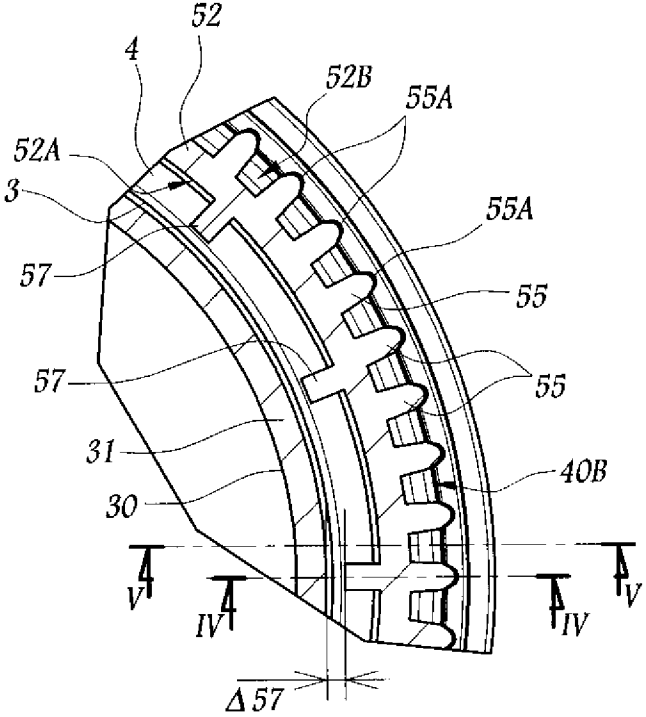
FIG. 3 is a partial section taken along the line III-III in FIG. 2.

By way of advantageous optional features, the interior cylindrical surface 52A of the intermediate part 52 of the top skirt part 50 is provided with radially projecting ribs 57. The benefit of these optional ribs 57 is linked to the fact that, in the direction of the axis X-X, each of these ribs 57 extends to the axial level of the surface 54A, as can be seen clearly in FIGS. 2 and 4, so that each of these ribs 57 delimits at its lower axial end a surface 57A which, when the cap 1 is plugging the container neck 2 as in FIG. 2, abuts in the axially downward direction against the free end 4 of the ring 3 of the container neck 2, to be more precise against the edge 4A of this free end 4. This amounts to saying that the surface 54A leads locally, at the radial level of each of the ribs 57, onto the corresponding surface 57A, these surfaces 57A thus reinforcing the axial abutment of the top skirt part 50 against the free end 4 of the ring 3 and thus enabling a higher tightening torque to be applied to the cap 1 when it is screwed around the container neck 2. In practice, it will be noted that the surface 54A and the surfaces 57A are arranged so that, on screwing the cap 1 all the way around the container neck 2, the surface 54A interferes with the exterior edge 4B of the free end 4 of this neck before the surfaces 57A bear against the edge 4A: this favours the sealed bearing of the skirt part 50 on the container neck 2 by way of the cooperation between the shouldered surface 54A and the edge 4B of this neck, whereas, thanks to the subsequent cooperation between the surfaces 47A and the edge 4A at the end of the container neck the risk of the skirt part 50 flaring radially outward, by sliding of the bottom end 51 of the skirt part 50 against the edge 4B of the container neck 2, as a result in particular of the application to the cap of too high a tightening force, is significantly reduced. To preserve the flexibility of the sealing lip 30, each of the ribs 57 is at a radial distance from the upper part 32 of this lip 30, as can be seen clearly in FIG. 3. This radial distance, denoted 157 in FIG. 3, is advantageously made greater than the projecting radial dimension of the raised pattern 33 relative to the rest of the lip 30, so that, on extraction of the cap 1 from the mould, the raised pattern 33 does not rub against the elements for moulding the ribs 57, which would have the harmful consequence of scratching this raised pattern 33 and therefore compromising its sealing performance.

Figure 6:
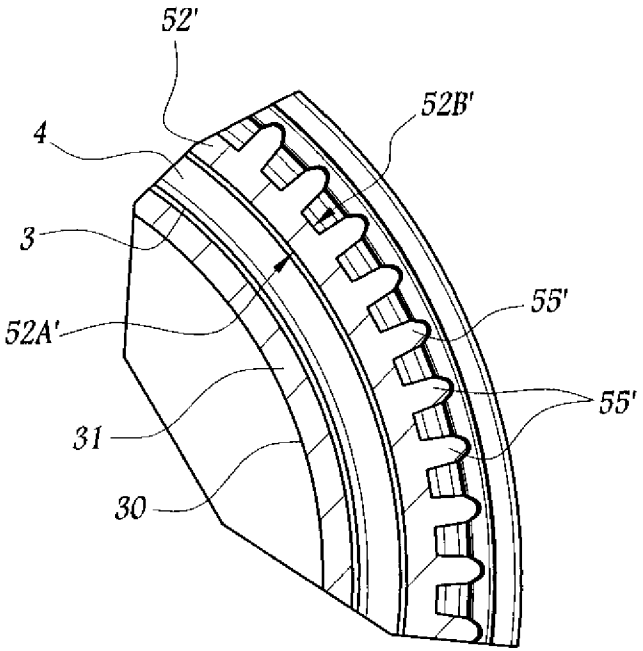
FIG. 6 is a view analogous to FIG. 3 showing a variant of the first embodiment of the invention.

It is again emphasized here that the ribs 57, just described above, are optional. Accordingly, in FIG. 6 there is represented a variant of the cap 1 without these ribs 57. This amounts to saying that, for this embodiment, the top skirt part 50' includes a top end 53' identical to the top end 53 of the skirt part 50, a bottom end 51', notably with an interior shoulder 54' delimiting an axial abutment surface 54A', that is identical to the bottom end 51, with its shoulder 54 and its surface 54A, of the skirt part 50, and an intermediate part 52' which has both a thickness e52' identical to the thickness e52 of the intermediate part 52 and an exterior cylindrical surface 52B', notably with exterior ribs 55', identical to the surface 52B, with its ribs 55, of the part 52, but the interior cylindrical surface 52A' of which is smooth, as can be seen clearly in FIG. 6. It will be noted that, in a plane identical to that of FIG. 5, this variant shown in FIG. 6 has a section identical to that shown in FIG. 5 for the cap 1 from FIGS. 1 to 5, which explains why, in FIG. 5, there are shown conjointly the reference numbers associated with the cap 1 and those associated with its FIG. 6 variant. Of course, the components of the cap of the FIG. 6 variant other than its top skirt part 50' are identical to those of the cap 1 from FIGS. 1 to 5 and therefore bear the same reference numbers.

In FIGS. 7 to 10 there is represented a cap 101 adapted to be removably attached around the container neck 2 in order to plug the latter in substantially the same way as the cap 1. As can be seen clearly on comparing FIGS. 1 to 5 and FIGS. 7 to 10, the cap 101 differs from the cap 1 only in the top part 150 of its skirt 120, while its end wall 110, the bottom part 140 of its skirt 120, its sealing lip 130 and its tamper-evident strip 160 are identical to the end wall 10, bottom skirt part 40, sealing lip 30 and tamper-evident strip 60, respectively, of the cap 1. These components common to the cap 1 and the cap 101 will not be described further with reference to FIGS. 7 to 10 on the understanding that, in the aforementioned figures, the elements of the cap 101 featured identically in the cap 1 bear the same reference numbers as those of the cap 1 increased by 100.

Figure 8:
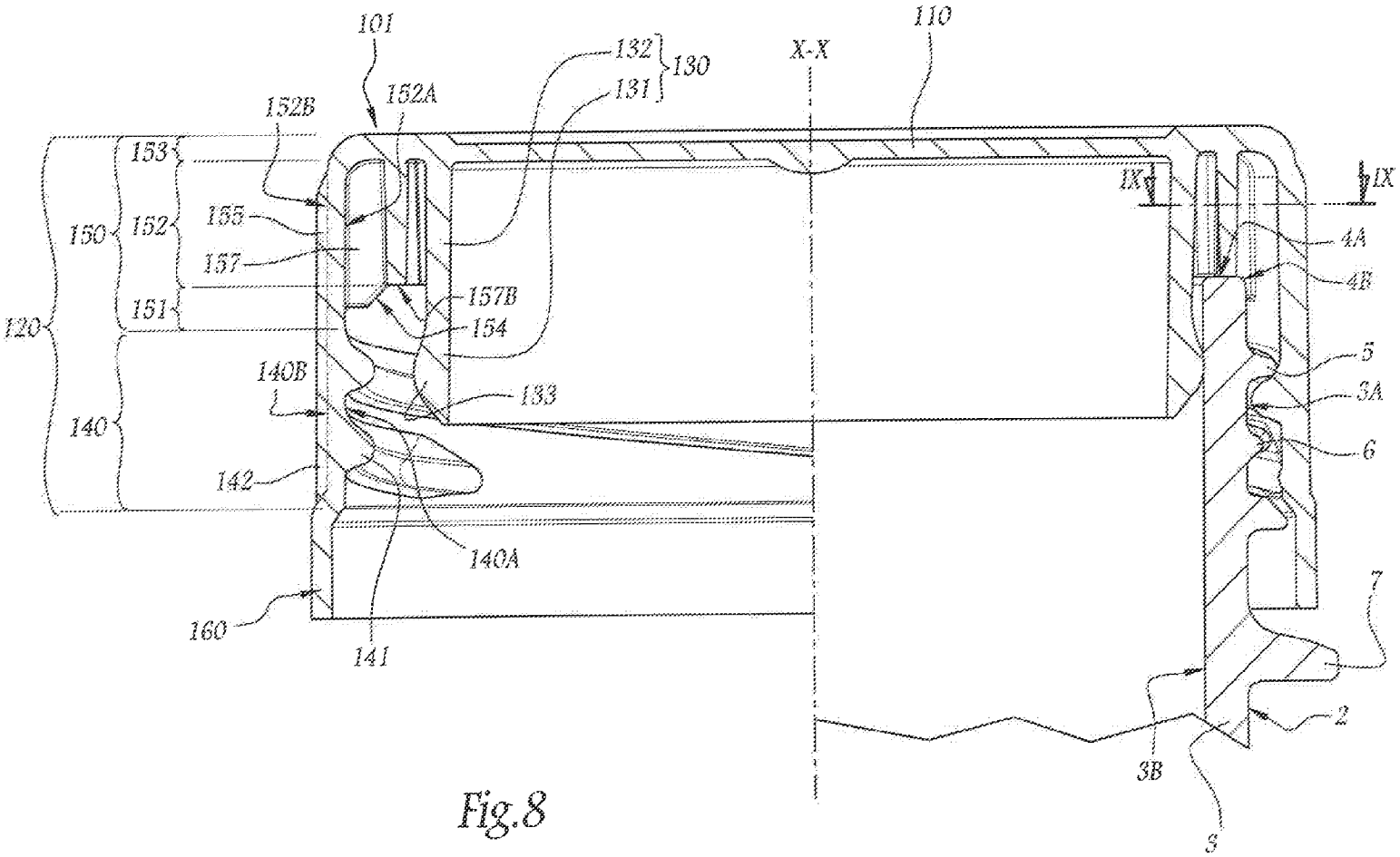
FIG. 8 is an axial section of the cap from FIG. 7, the left-hand half of this section showing the cap on its own while the right-hand half of this section shows the cap plugging a container neck.
Figure 10:
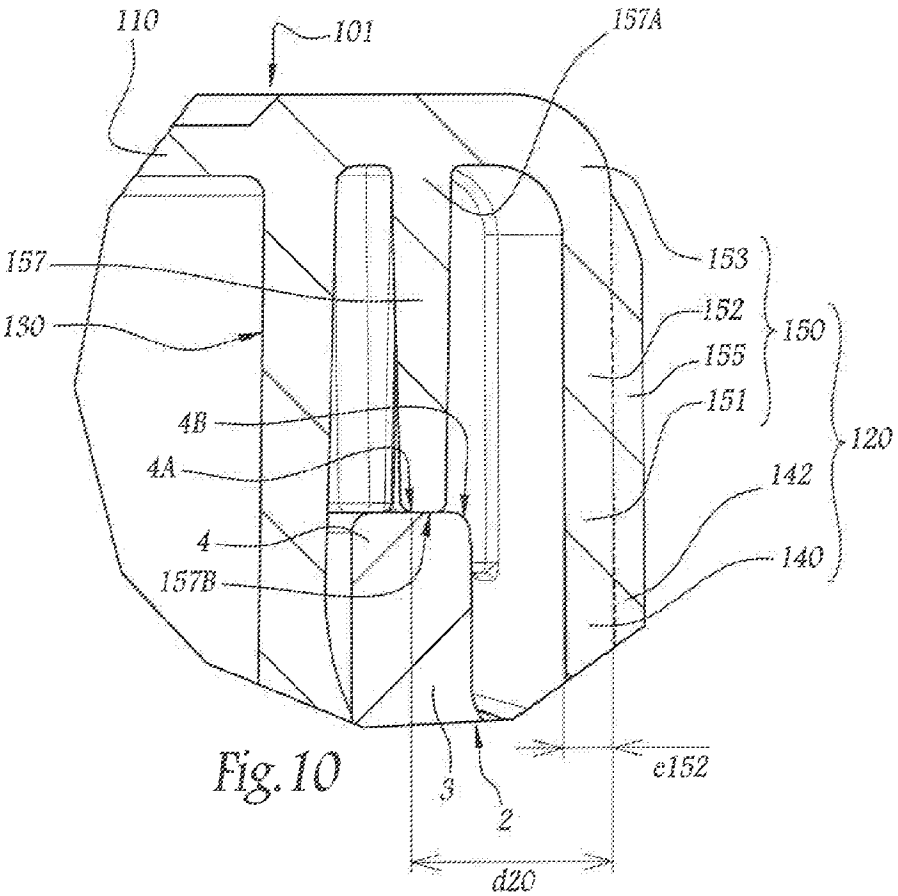
FIG. 10 is a section taken along the line X-X in FIG. 9.

Considering further the top part 150 of the skirt 120, it is seen that, differing in this respect from the skirt part 50, the skirt part 150 does not have a reduced diametral dimension relative to the bottom skirt part 140 but to the contrary, as can be seen clearly in FIGS. 8 and 10, the interior cylindrical surface 152A and the exterior cylindrical surface 152B of the intermediate part 152 of the skirt part 150 are aligned axially with the interior cylindrical surface 140A and the exterior cylindrical surface 140B, respectively, of the bottom skirt part 140. The bottom end 151 of the skirt part 150 is, without radial discontinuity, in axial alignment with the top skirt part 150 and the bottom skirt part 140. Accordingly, the top end 153 of the skirt part 150 connects the rest of this skirt part 150 to the end wall 110 which, given the greater diametral dimensions of the skirt part 150 compared to the skirt part 50, has an outside diameter greater than the outside diameter of the end wall 10 of the cap 1. This amounts to saying that, as can be seen clearly in FIG. 7, the skirt 120 has over substantially all of its axial dimension a constant diametral dimension, the exterior face of this skirt 120 thus being usable, over the whole of its axial dimension, by the fingers of the user to manipulate the cap 101, notably to turn it on itself about the axis X-X. Moreover, to facilitate turning it, the exterior face of the skirt 120 is advantageously ribbed: as can be seen clearly in FIG. 7, this amounts to saying that the exterior cylindrical surface 152B of the intermediate part 152 of the top skirt part 150 is provided with optional ribs 155 projecting radially outward which, in the direction of the axis X-X, are in rectilinear alignment with an associated optional rib 142 that projects radially from the exterior cylindrical surface 140B of the bottom skirt part 140, these ribs 155 and 142 being regularly distributed, advantageously in a substantially uniform manner, around the exterior periphery of the skirt 120.

Figure 9:
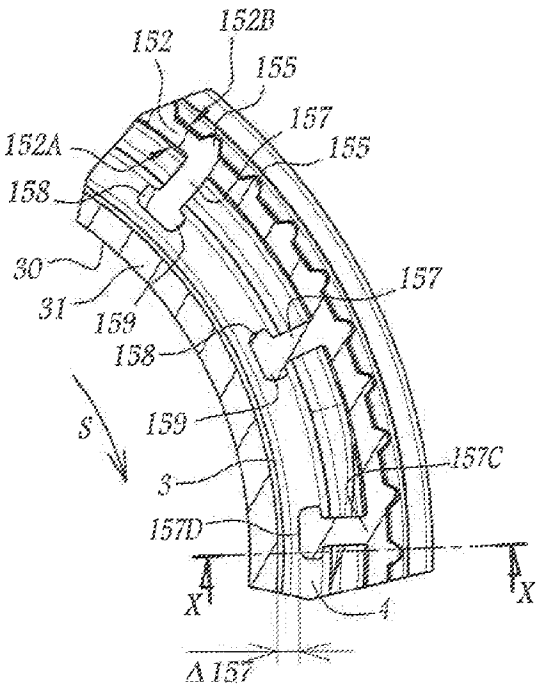
FIG. 9 is a partial section taken along the line IX-IX in FIG. 8.

As can be seen clearly in FIGS. 8 to 10, the interior cylindrical surface 152A of the intermediate part 152 of the top skirt part 150 is provided with radially projecting ribs 157 that extend axially from the axial level of the top end 153 to the axial level of the bottom end 151. In other words, each of the ribs 157 has, opposite each other in the direction of the axis X-X, a top axial edge 157A that connects the rest of the rib 157 to the end wall 110, being moulded in one piece with this end wall in the embodiment considered in the figures, and a lower axial edge which, at least in its exterior part, delimits a free surface 157B facing toward the bottom skirt part 140. Moreover, in section in a plane perpendicular to the axis X-X, as represented in FIG. 9, each of the ribs 157 has a substantially rectangular contour in the lengthwise direction of which are opposed the radial edges of the rib, namely, on the one hand, an exterior radial edge 157C that connects the rest of the rib 157 to the interior cylindrical surface 152A of the intermediate part 152 of the top skirt part 150, being moulded in one piece with this interior cylindrical surface 152A in the embodiment considered in the figures, and, on the other hand, an interior radial edge 157D that is free.

Accordingly, the ribs 157 stop downward axial movement of the top skirt part 150 relative to the container neck 2 when the latter is plugged by the cap 101, as in FIG. 8: to this end, the lower surface 157B of each of the ribs 157 constitutes a downward axial abutment surface for the skirt part 150 and thus for the whole of the cap 101. In particular, in a similar manner to the ribs 57 of the cap 1, the surfaces 157B of the ribs 157 are adapted to bear axially against the edge 4A of the free end 4 of the ring 3 of the container neck 2. As in the embodiment considered in the figures, each of these surfaces 157B, all of which are inscribed within the same plane perpendicular to the axis X-X, is advantageously extended outward by an optional downwardly inclined surface 154 that is delimited by the interior part of the lower axial edge of the rib 157 and that bears on a local portion of the edge 4B of the free end 4 of the ring 3 when the container neck 2 is plugged by the cap 101.

It will be noted that, in that the ribs 157 are distributed about the interior periphery of the top skirt part 150, being spaced from each other around that periphery, the axial abutment effect of these ribs does not imply a massive construction of the top skirt part 150: in other words, in a similar manner to what is described above for the skirt part 50, in axial half-section of the skirt 120, the intermediate part 152 of the skirt part 150 has, outside the ribs 155 and 157, a thickness e152, i.e. a radial dimension, that is strictly less than the radial distance d120 between the exterior cylindrical surface 140B of the bottom skirt part 140 and the interior radial end of the abutment surfaces 157B, as indicated in FIG. 10.

Moreover, and also as can be seen clearly in FIG. 10, it will be noted that the upper edge 157A of each of the ribs 157 is not connected directly to the upper axial part 132 of the sealing lip 130 but, to the contrary, is at a radial distance from this lip part 132 over the whole of the axial dimension of this lip part 132: in a similar manner to what has been described for the ribs 57 of the cap 1, this arrangement preserves the flexibility of the sealing lip 130. Moreover, the radial distance denoted Δ157 in FIG. 9 between the interior radial edge 157D of each rib 157 and the upper part 132 of the sealing lip 130 is advantageously made greater than the projecting radial dimension of the raised pattern 133 provided on the exterior surface of the lower part 131 of the lip 130: as a result, as already mentioned for the ribs 57 of the cap 1, the lip 130 can be extracted from the mould without risk of its sealing raised pattern 133 interfering with the arrangements necessary for moulding the ribs 157, thereby preventing scratching of this raised pattern 133.

With regard to the foregoing explanations, it is clear that the cap 101 has substantially the same advantages as the cap 1 in so far as concerns its advantageous capability to provide a large axial, extent for its skirt 120 whereas its bottom skirt part 140 has the exact axial dimensions, i.e. is designed to cooperate with the ring 3, which has a particularly small axial dimension. In particular, the values proposed above for the axial dimensional ratio between the skirt parts 40 and 50 also prove relevant for the skirt 120: in other words, the skirt part 150 advantageously has a total axial dimension of at least 50%, or even 100%, or more, of the axial dimension of the thread 141 of the bottom skirt part 140.

By way of an advantageous optional arrangement, the interior radial edge 157D of each rib 157, as seen in section in a plane perpendicular to the axis X-X, does not have a contour that is rigorously inscribed with the rest of the globally rectangular contour of the rib 157 but, as represented in FIG. 9, has an enlarged contour on either side of the main faces of the rib 57, i.e. the opposite faces in the widthwise direction of the substantially rectangular contour of the rib. This amounts to saying that, overall, in section in a plane perpendicular to the axis X-X, each rib 57 has a T-shaped overall contour with the crossbar of this T-shape corresponding to the interior radial edge 157D. In other words, the interior radial edge 1571 includes two enlargements 158 and 159 projecting from a respective one of the two main faces of the rim 157. These enlargements 158 and 159 extend axially over the whole of the axial dimension of the rib 157, in particular as far as its lower axial edge, thus extending the abutment surface 157B in a direction orthoradial to the axis X-X. As well as extending the abutment surface 157B, these enlargements 158 and 159 have the advantage of stiffening each rib 157 at the level of its interior radial edge 157D. In this way, when the cap 101 is screwed all the way onto the container neck 2 and, as explained above, the surfaces 157B and 154 of the ribs 157 come to bear axially against the free end 4 of the ring 3 of this container neck, the enlargements 158 and 159 limit the deformation in bending suffered by the ribs 157 through rotary rubbing contact against the free end 4 of the ring 3. It is thus clear that the stiffening effect of the enlargement 158 is particularly useful in that this enlargement 158 projects from the face of the rib 157 facing in the opposite direction to the direction indicated by the curved arrow S in FIG. 9 of screwing the cap 101 around the container neck 2. Of course, even if to a lesser extent, the opposite enlargement 159 of each rib 157 also participates in limiting the deformation in bending of the rib.

Figure 12:
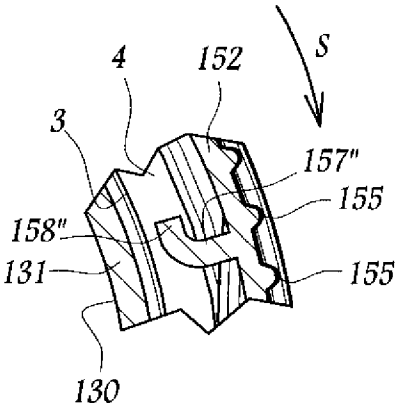
Figure 11:
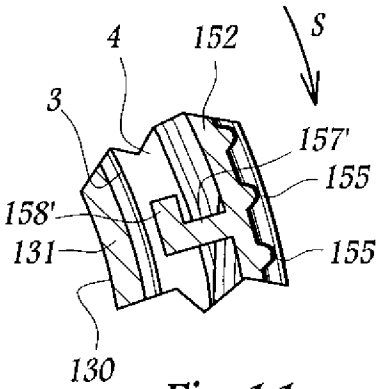

On the basis of the immediately preceding considerations, the benefit of the two variants from FIGS. 11 and 12 is clear. In these FIGS. 11 and 12, the respective ribs 157' and 157", which are functionally similar to the rib 157 described until now, do not have, in a plane perpendicular to the axis X-X, a T-shaped contour, like the rib 157, but L-shaped and J-shaped contours, respectively. In other words, each of these ribs 157' and 157" does not have, at its interior radial edge, two opposed, enlargements, like the enlargements 158 and 159, but a single enlargement 158', 158" that advantageously projects from the main face of the rib 157', 157" that faces away from the screwing direction S.

Figure 13:
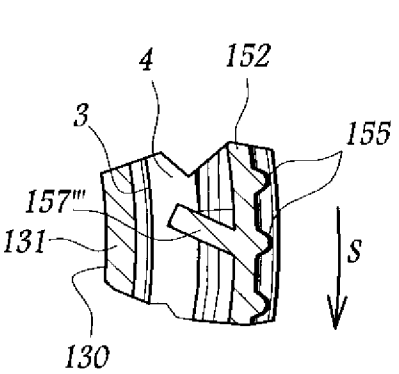
FIGS. 11, 12 and 13 are views analogous to FIG. 9 showing three variants of the second embodiment.

In FIG. 13, a variant 157'" of the rib 157 has neither of the enlargements 158 and 159, but differs from the rib 157 in that the lengthwise direction of its rectangular contour is not in a direction radial to the axis X-X, but is inclined relative to that radial direction. To reinforce the effect of resistance to deformation of the rib 157'", the aforementioned inclination is advantageously provided on the side of the aforementioned radial direction, which faces away from the screwing direction S.

Of course, where the variants described above with reference to FIGS. 11 to 13 are concerned, the components of the corresponding caps other than the ribs 157', 157" and 157'" are identical to those of the cap 101 and therefore bear the same reference numbers in the case of those that can be seen in these FIGS. 11, 12 and 13.

Diverse arrangements and variants of the caps 1 and 101 and their variants described until now may also be envisaged. For example:

- the arrangements relating to the ribs 157, 157', 157" and 157'" may be combined with each other; of course, some or all of these arrangements may be applied to the ribs 57 of the cap 1;
- where the exterior ribs 42, 55, 142 and 155 are concerned, it will be noted that their profile is not limiting on the present invention; accordingly, compared to what can be seen in the figures, the free end of these ribs may be made more angular or more rounded; and/or
- embodiments other than the threads 41 and 141 may be envisaged with regard to the removable fixing of the bottom part 40, 140 of the skirt 20, 120; for example, this bottom skirt part may be provided internally with one or more clips designed to wedge against an exterior raised pattern projecting from the free end of the ring of the container neck.

The invention claimed is:

1. A cap for a container neck, comprising:

a tubular skirt having a central axis and including:

a first skirt section extending along the central axis and having threads for removably fixing the first skirt section to an exterior surface of the container neck, and a second skirt section including:

a first axial end having at least one abutment surface adapted to abut axially against an end of the container neck when the first skirt section is removably fixed to the container neck;

a second axial end opposite the first axial end and connected to an end wall of the cap; and an intermediate section extending axially between the first and second axial ends, wherein a plurality of ribs project radially from the intermediate section towards the central axis and extend lengthwise substantially parallel to the central axis, wherein the plurality of ribs are distributed around the central axis, and wherein a radial thickness of the intermediate section is less than a radial distance between an exterior cylindrical surface of the first skirt section and an interior radial end of the at least one abutment surface, wherein each of the plurality of ribs includes:

an exterior radial end connected to an interior cylindrical surface of the intermediate section;

an interior radial end radially opposite the exterior radial end;

a first axial end connected to the end wall of the cap; and a second axial end having a lower surface, wherein the at least one abutment surface corresponds to the lower surface of at least one of the plurality of ribs.

2. The cap according to claim 1, wherein the second skirt section has a total axial dimension of at least 50% of the axial dimension of the first skirt section having the threads.

3. The cap according to claim 1, further comprising:

an annular sealing lip coaxial with and inside the tubular skirt, wherein the sealing lip projects axially from the end wall of the cap at a first radial distance from an interior cylindrical surface of the first skirt section, and an interior cylindrical surface of the second skirt section.

4. The cap according to claim 1, wherein diameters of the interior cylindrical surface of the intermediate section and exterior cylindrical surface of the intermediate section are less than diameters of an interior cylindrical surface of the first skirt section and an exterior cylindrical surface of the first skirt part, wherein the at least one abutment surface is at least partially defined by an interior shoulder of the first axial end of the second skirt section, and wherein the plurality of ribs is a first plurality of ribs; and a second plurality of ribs project from the exterior cylindrical surface of the intermediate section of the second skirt section.

5. The cap according to claim 4, wherein the exterior radial end of each of the second plurality of ribs is located at a radial distance from the central axis equal to or greater than the radius of the exterior cylindrical surface of the first skirt section.

6. The cap according to claim 4, wherein each of the second plurality of ribs extend in the direction of the central axis in line with an associated rib projecting from the exterior cylindrical surface of the first skirt section.

7. The cap according to claim 4, wherein the at least one abutment surface extends continuously around an entire interior periphery of the first axial end, forming a sealing line against an exterior edge of an end of the container neck.

8. The cap according to claim 7, wherein the at least one abutment surface is substantially frustoconical, centered on the central axis, and converges toward the second skirt section.

9. The cap according to claim 4, wherein the first plurality of ribs project from the interior cylindrical surface of the intermediate section of the second skirt section and extend axially to the at least one abutment surface such that each of the first plurality of ribs defines at least a portion of the at least one abutment surface other than the portion of the at least one abutment surface at least partially defined by the interior shoulder.

10. The cap according to claim 1, wherein the interior cylindrical surface of the intermediate section and an exterior cylindrical surface of the intermediate section are axially aligned with an interior cylindrical surface of the first skirt section and an exterior cylindrical surface of the first skirt section, and wherein the plurality of ribs project from the interior cylindrical surface of the intermediate section of the second skirt section and extend axially to the first end of the second skirt section such that each rib has a respective abutment surface configured to abut axially the end of the container neck when the first skirt section is removably fixed to the container neck.

11. The cap according to claim 10, wherein the plurality of ribs is a first plurality of ribs, and a second plurality of ribs each project from the exterior cylindrical surface of the intermediate section of the second skirt section and extend in the direction of the central axis in line with an associated rib projecting from the exterior cylindrical surface of the first skirt section.

12. The cap according to claim 1, wherein the interior radial end of each of the plurality ribs includes a stiffening enlargement projecting from at least one of two faces of the corresponding rib.

13. The cap according to claim 1, wherein each of the plurality of ribs includes an extension projecting radially outward from the second axial end, the extension having an inclined surface that extends from the second axial end to the exterior radial end and being adapted to abut axially against the end of the container neck.

14. The cap according to claim 1, wherein the plurality of ribs are spaced apart from one another around the central axis, and wherein each of the plurality of ribs has, in a plane perpendicular to the central axis, an overall contour defining the spaced apart distribution of the plurality of ribs around the central axis.

15. The cap according to claim 14, wherein the overall contour is a substantially rectangular contour.

16. The cap according to claim 14, wherein the overall contour is a substantially T-shaped contour.

* * * * *